US009120312B2

(12) United States Patent
Kinoshita

(10) Patent No.: US 9,120,312 B2
(45) Date of Patent: Sep. 1, 2015

(54) LIQUID EJECTING HEAD AND LIQUID EJECTING APPARATUS

(71) Applicant: SEIKO EPSON CORPORATION, Tokyo (JP)

(72) Inventor: Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/456,587

(22) Filed: Aug. 11, 2014

(65) Prior Publication Data

US 2015/0054889 A1 Feb. 26, 2015

(30) Foreign Application Priority Data

Aug. 20, 2013 (JP) ..... 2013-170800

(51) Int. Cl.

| | |
|---|---|
| ***B41J 2/19*** | (2006.01) |
| ***B41J 2/175*** | (2006.01) |
| ***B41J 2/14*** | (2006.01) |

(52) U.S. Cl.

CPC ..... *B41J 2/14233* (2013.01); *B41J 2/175* (2013.01); *B41J 2/17563* (2013.01); *B41J 2/19* (2013.01); *B41J 2202/11* (2013.01)

(58) Field of Classification Search

CPC ..... B41J 2/19; B41J 2/175; B41J 2/17513; B41J 2/17596; B41J 2/17563; B41J 2/17523; B41J 2202/07; B41J 2202/14403; B41J 2/1631

See application file for complete search history.

(56) References Cited

U.S. PATENT DOCUMENTS

2001/0030676 A1* 10/2001 Owaki et al. ..... 347/93

FOREIGN PATENT DOCUMENTS

JP 2013-082185 5/2013

* cited by examiner

*Primary Examiner* — Geoffrey Mruk

(74) *Attorney, Agent, or Firm* — Workman Nydegger

(57) ABSTRACT

A liquid ejecting head may include a first flow path, a linking flow path that is provided on a downstream side of the first flow path and is connected to the first flow path, and a second flow path that is connected to the linking flow path. The first flow path, the linking flow path, and the second flow path are provided in a portion between a liquid receiving portion and a filter. The second flow path includes wall portions that partition a central flow path and external flow paths which are provided on both external sides of the central flow path. The linking flow path includes an inclined portion which is formed in a width direction and extends in a portion between the first flow path and the second flow path.

8 Claims, 8 Drawing Sheets

LIQUID EJECTING HEAD AND LIQUID EJECTING APPARATUS

CROSS REFERENCE TO RELATED APPLICATIONS

The present application claims priority to Japanese Patent Application No. 2013-170800 filed on Aug. 20, 2013 which is hereby incorporated by reference in its entirety.

BACKGROUND

1. Technical Field

Embodiments of the present invention relate to a liquid ejecting head which ejects liquid through nozzle openings and a liquid ejecting apparatus. More particularly, embodiments relate to an ink jet type recording head which discharges ink as liquid and an ink jet type recording apparatus.

2. Related Art

An ink jet type recording head which discharges ink droplets is a representative example of a liquid ejecting head which discharges liquid droplets. An ink jet type recording head that may include a head main body which discharges ink droplets through nozzle openings and a common flow-path member which allows ink sent from a liquid receiving portion to be supplied to each head main body has been proposed as an ink jet type recording head described above (see JP-A-2013-082185, for example). The liquid receiving portion may be an ink cartridge in which ink is received and which is fixed to the head main body.

In a flow-path member used for the ink jet type recording head described above, a vertical flow path through which ink flows in a vertical direction and a horizontal flow path which communicates with the vertical flow path are provided between a liquid receiving portion and a filter. An air bubble remaining portion in which air bubbles remain and a groove flow path which communicates with the air bubble remaining portion are provided in the horizontal flow path.

However, when a linking portion of the horizontal path, which is linked to an upstream side of the horizontal path, has a difference in level, a corner portion may be formed by the difference in level. An air bubble may remain in the corner portion due to the difference in level. Then, the air bubble remaining in the corner portion grows and may flow at an unexpected time. As a result, a problem or failure, such as an ink discharging failure, may occur. Furthermore, when an opening of the groove flow path is small, a flow-path resistance is caused and the path is choked by the air bubble. Thus, there is a possibility that an ink supply failure may occur.

In addition, t is necessary to provide a space for forming the groove flow path. Providing for the groove flow path can cause problems because it is necessary to form the flow-path member to have a certain degree of height. As a result, a member may increase in size (area). Particularly, when the groove flow path is provided on a lower side of the air bubble remaining portion in the vertical direction, it is necessary to increase the height of the flow-path member 30 by the size of the groove flow path. As a result, the flow-path member 30 increases in size.

The problems described above are not limited to an ink jet type recording head but are also common to a liquid ejecting apparatus which ejects a liquid other than ink.

SUMMARY

An advantage of some aspects of embodiments of the invention is to provide a liquid ejecting apparatus and a liquid ejecting head in which a relatively large air bubble can remain and which can prevent a liquid filling failure and achieve a reduction in size.

According to an aspect of an embodiment of the invention, a liquid ejecting head is provided. The liquid ejecting head may include a first flow path, a linking flow path that is provided on a downstream side in a liquid flowing direction of the first flow path and that is connected to the first flow path. The liquid ejecting head may include a second flow path that is connected to the linking flow path and extends in a horizontal direction perpendicular to a vertical direction. The first flow path, the linking flow path, and the second flow path may be provided in a portion between a liquid receiving portion in which liquid is received and a filter. The second flow path may have wall portions that partition a central flow path of which a width in the horizontal direction is greater than that of the first flow path and which is provided on the central side and extends in the liquid flowing direction. The second flow path may have external flow paths which are provided on both external sides of the central flow path and are formed to have a width less than that of the central flow path. The linking flow path may have an inclined portion which is formed in a width direction and extends in a portion between the first flow path and the second flow path.

In one embodiment, the central flow path and the external flow path are provided in the second flow path. Thus, even when a relatively large air bubble is accommodated in the central flow path, it is possible to supply liquid to a downstream side through the external flow path. Therefore, it is possible to accommodate a large air bubble without increasing the size of the flow-path member in the vertical direction. Furthermore, the inclined portion may be provided in the linking flow path, without providing the wall portion, and the air bubble is prevented from remaining during a liquid filling period. As a result, it is possible to prevent a liquid filling failure.

In the liquid ejecting head, the depth of the second flow path may be greater than that of the first flow path and the linking flow path may have an inclined portion which is formed in a depth direction and that extends in a portion between the first flow path and the second flow path. In one embodiment, a difference in level, which is caused by a difference in lengths in the depth direction, can be suppressed by the inclined portion. Thus it is possible to prevent the filling failure due to remaining of an air bubble.

In the liquid ejecting head, the first flow path may extend in the horizontal direction.

The liquid ejecting head may further include a third flow path which is connected to a downstream side of the second flow path and through which liquid flows in a vertical direction. The third flow path may have a central flow path for provided on the central side (or in the center of the third flow path) and external flow paths which are provided on both external sides of the central flow path. In one example, the air bubble may be accommodated in the central flow path of the third flow path. Thus, it is possible to supply liquid to the downstream side through the external flow path of the third flow path.

According to another aspect of embodiments of the invention, a liquid ejecting apparatus that includes the liquid ejecting head described above is provided.

It is possible to realize a liquid ejecting apparatus which can prevent a liquid filling failure and achieve a reduction in size.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, detail of embodiments of the invention will be described.

Figure 1:
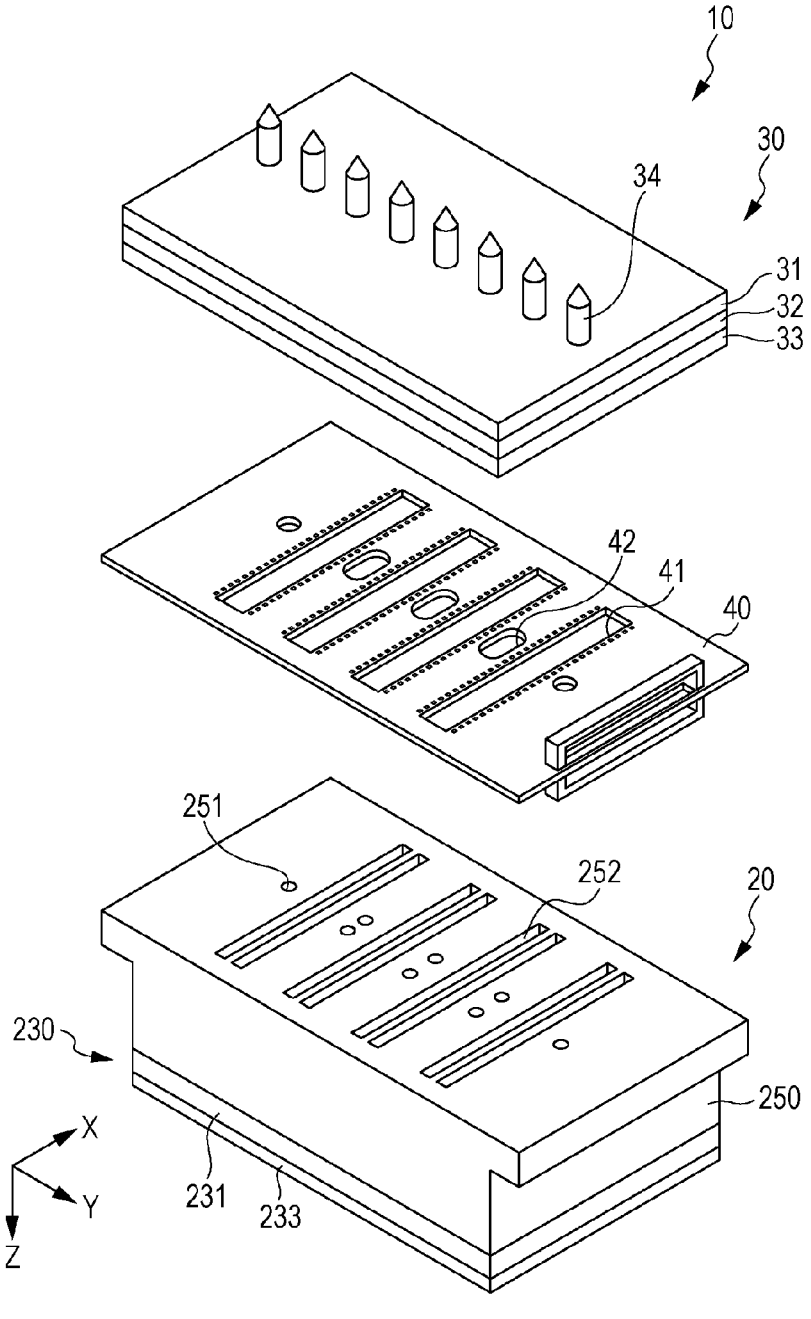
FIG. 1 is an exploded perspective view of an example of a recording head.

FIG. 1 is an exploded perspective view illustrating an ink jet type recording head as an example of a liquid ejecting head An ink jet type recording head 10 may include a head main body 20 which can eject a liquid such as ink droplets, a flow-path member 30 which supplies ink to the head main body 20, and a wiring substrate 40 which is held between the head main body 20 and the flow-path member 30, as illustrated in FIG. 1.

Figure 2A:
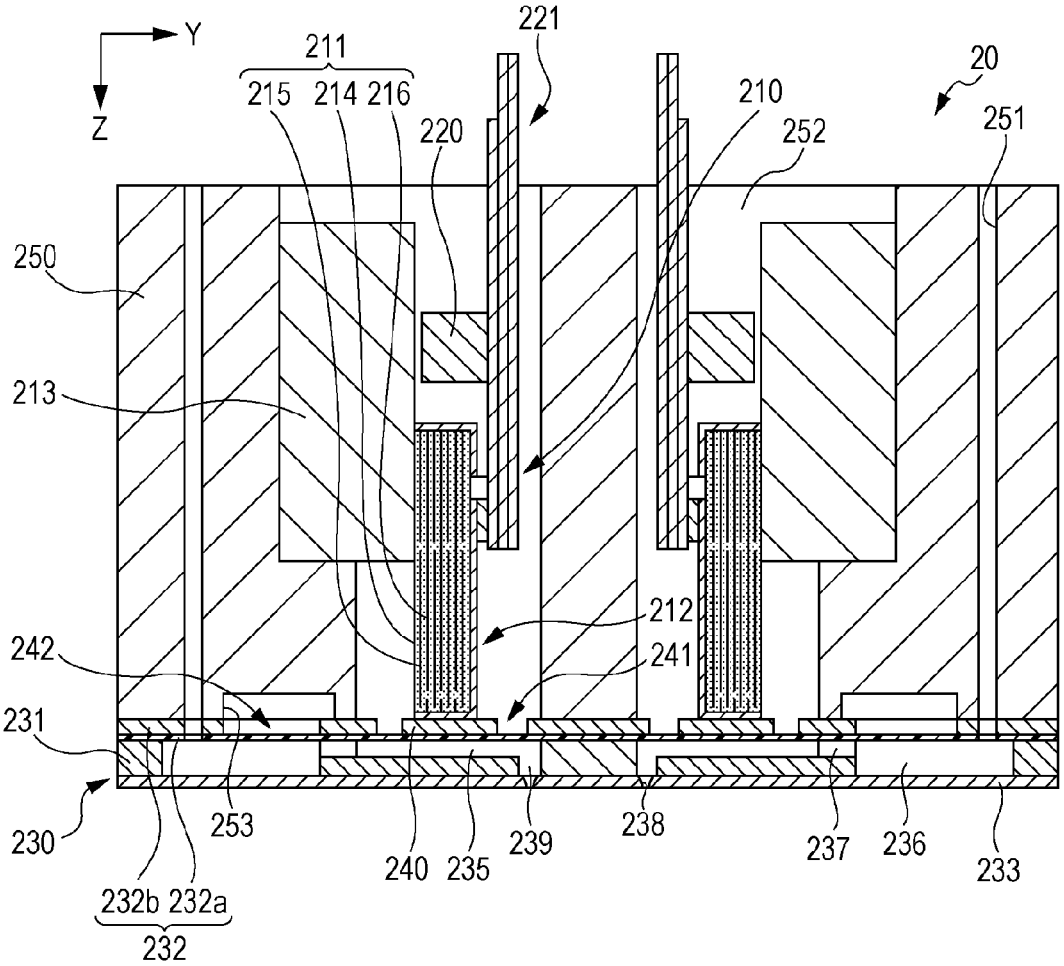
FIGS. 2A and 2B are cross-sectional views of principal portions of an example of a head main body.
Figure 2B:
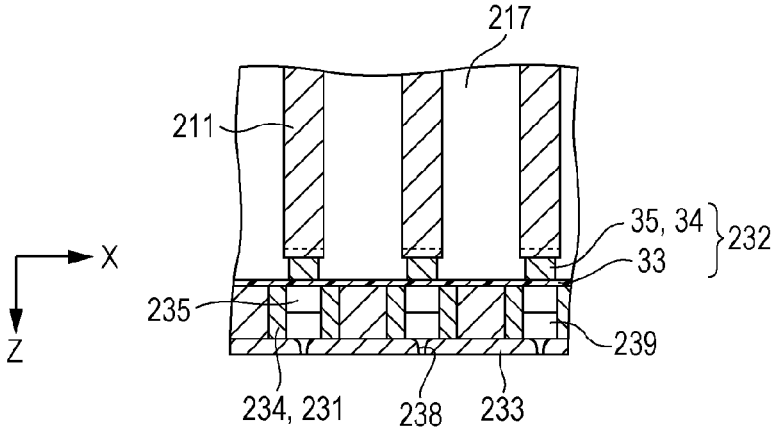

Detail of the head main body 20 will be described with reference to FIGS. 2A and 2B. FIGS. 2A and 2B are cross-sectional views of principal portions of the head main body.

The head main body 20 may include a plurality of actuator units 210, a case 250 in which the actuator units 210 can be accommodated, and a flow path unit 230 which is adhered to one surface of the case 250, as illustrated in FIGS. 2A and 2B.

The actuator unit 210 may include a piezoelectric actuator forming member 212 around which a plurality of piezoelectric actuators 211 are aligned in a width direction and a fixing plate 213 to which a base portion (the other end portion) of the piezoelectric actuator forming member 212 is fixed to form a fixed end such that a tip portion (one end portion) of the piezoelectric actuator forming member 212 is set to be a free end.

The piezoelectric actuator forming member 212 is formed by alternately stacking the piezoelectric material 214 and internal electrodes which constitute two electrodes of the piezoelectric actuator 211. In other words, the two electrodes include individual internal electrodes 215 and common internal electrodes 216. The individual internal electrode 215 constitutes an individual electrode which is electrically independent with respect to an adjacent piezoelectric actuator 211. The common internal electrode 216 constitutes a common electrode which is electrically connected, in common, to adjacent piezoelectric actuators 211.

A plurality of slits 217 are formed, using, for example, a wire-saw, on the piezoelectric actuator forming member 212. A tip portion side of the piezoelectric actuator forming member 212 is divided in a ctenidium shape and a row of the piezoelectric actuators 211 is formed in the divided tip portion.

In this case, a portion of the piezoelectric actuator 211, which is adhered to the fixing plate 213, is an inactive area which does not contribute to the generation of vibration. Thus, when voltage is applied to both the individual internal electrode 215 and the common internal electrode 216 which constitute the piezoelectric actuator 211, only a portion of the piezoelectric actuator 211, which is located on the tip portion side and is not adhered to the fixing plate 213, vibrates. A tip surface of the piezoelectric actuator 211 is fixed, using an adhesive, to an island portion 240 of a diaphragm 232 described below.

A circuit substrate 221, such as a COF, on which a driving circuit 220, such as a driving IC, for driving the piezoelectric actuator 211 is mounted is connected to each piezoelectric actuator 211 of the actuator unit 210.

The flow path unit 230 may include a flow-path forming substrate 231, the diaphragm 232, and a nozzle plate 233.

The flow-path forming substrate 231 may be constituted by a silicon single crystal substrate. Pressure generation chambers 235, which are formed by a plurality of partition walls 234, are arranged in the width direction (a lateral direction) on one surface portion of the flow-path forming substrate 231. Hereinafter, this direction will be referred to as an alignment direction of the pressure generation chambers 235 or a first direction X. Furthermore, a plurality (two, in one embodiment) of rows, each of which is constituted by pressure generation chambers 235 aligned in the first direction X, are provided on the flow-path forming substrate 231. Hereinafter, a row arrangement direction in which a plurality of rows are arranged, each of which is constituted by the pressure generation chambers 235 aligned in the first direction X, will be referred to as a second direction Y.

A manifold 236 which is used for supplying ink as liquid to each pressure generation chamber 235 communicates, through an ink supply path 237 as an example of a liquid supply path, with one end portion side of each pressure generation chamber 235 in the second direction Y. An opening surface side of the pressure generation chamber 235 of the flow-path forming substrate 231 is sealed by the diaphragm 232. The nozzle plate 233 which is an example of a nozzle forming member on which nozzle openings 238 are formed in a punched manner is adhered to the other surface side of the substrate 231 using, for example, an adhesive or a heat welding film. The nozzle opening 238 of the nozzle plate 233 and the pressure generation chamber 235 communicate with each other through a nozzle opening communication hole 239 which is formed to pass through the flow-path forming substrate 231.

The diaphragm 232 is a composite plate constituted by or that includes an elastic film 232*a* and a support plate 232*b*. The elastic film 232*a* is a first member constituted by, for example, an elastic member such as a resin film. The support plate 232*b* supports the elastic film 232*a* and is a second member constituted by, for example, metal material. The elastic film 232*a* side of the diaphragm 232 is adhered to the flow-path forming substrate 231. For example, the elastic film 232*a* may be constituted by a PPS (polyphenylene sulfide) film of approximately several μm in thickness. The support plate 232*b* may be constituted by a stainless steel plate (SUS) of approximately tens of μm in thickness.

An island portion 240 on which the tip portion of the piezoelectric actuator 211 abuts is provided in a portion of the diaphragm 232. An island portion 240 is opposite to each pressure generation chamber 235. In other words, a thin portion 241 (of which a thickness is less than the other portion of the diaphragm 232) is formed in a portion of the diaphragm 232 that is opposite to a peripheral portion of each pressure generation chamber 235. The island portion 240 is provided inside each thin portion 241. A tip portion of the piezoelectric actuator 211 of the actuator unit 210 described above is fixed, using an adhesive or the like, to the island portion 240 described above.

A compliance portion 242, which is formed by removing the support plate 232*b* in an etching manner, and thus is practically constituted by only the elastic film 232*a*, similarly to the thin portion 241, is provided in a portion of the diaphragm 232 that is opposite to the manifold 236. When a pressure change is generated in the manifold 236, the compliance portion 242 absorbs the pressure change in such a manner that the elastic film 232*a* of the compliance portion 242 is deformed. The compliance portion 242 serves to maintain a constant pressure in the manifold 236.

In one embodiment the diaphragm 232 is constituted by the elastic film 232*a* and the support plate 232*b*. In one embodiment, the peripheral portion of the island portion 240 and the compliance portion 242 of the diaphragm 232 are constituted by only the elastic film 232*a*. However, the configuration is not limited thereto. For example, the diaphragm 232 may be a formed of a single plate. The island portion 240 and the compliance portion 242 may be formed in such a manner that one plate-shaped member is used as a diaphragm. Concave-shaped thin portions 241 and 242 are formed on the plate-shaped member by removing a part of the plate-shape member in a thickness direction.

The case 250 is fixed to an upper side of the diaphragm 232 of the flow-path forming substrate 231. The case 250 is connected, through the wiring substrate 40, to the flow-path member 30 which is located on a side of the wiring substrate 40 opposite to the diaphragm 232. An ink introduction path 251 through which the ink is supplied from a liquid storage portion (not illustrated), such as an ink cartridge, to the manifold 236 is provided in the case 250.

A plurality of accommodation portions 252 which pass through the case 250 in the thickness direction are provided in the case 250. The actuator unit 210 is positioned at and fixed to each accommodation portion 252. In one embodiment, eight actuator units 210 are provided and eight accommodation portions 252 are provided such that the actuator units 210 are separately accommodated in the accommodation portions 252.

A compliance space 253 having a concave shape is provided in a part of the case 250, which is opposite to the compliance portion 242, so as to be opened. The compliance portion 242 is held to be deformable by the compliance space 253. In other words, the compliance portion 242 provides space that allows the compliance portion 242 to deform.

The wiring substrate 40 in which a conductive pad to which each wiring of a circuit substrate 221 is connected is provided is fixed to a surface located opposite to a surface of the case 250 that is adhered to the diaphragm 232, as illustrated in FIG. 1. The accommodation portion 252 of the case 250 is practically covered by the wiring substrate 40. An opening portion 41 having a slit shape is formed in a part of the wiring substrate 40 that faces the accommodation portion 252 of the case 250. The circuit substrate 221 projects outside the accommodation portion 252 through the opening portion 41 of the wiring substrate 40. The circuit substrate 221 is electrically connected to a surface of the wiring substrate 40 that is located on a side of the wiring substrate 40 opposite to the case 250.

An insertion portion 42 through which a protrusion portion of the flow-path member 30 is inserted is provided in the wiring substrate 40. A flow path is provided in the flow-path member 30. The flow path of the flow-path member 30, which is inserted through the insertion portion 42, communicates with the ink introduction path 251.

In the head main body 20 described above, when the head main body 20 discharges ink droplets, a volume of each pressure generation chamber 235 is changed when the piezoelectric actuator 211 and the diaphragm 232 are deformed. Thus the ink droplets are discharged through the predetermined nozzle openings 238. Specifically, when the ink is supplied from an ink cartridge (not illustrated) to the manifold 236 through the ink introduction path 251 which is provided in the case 250, the ink is distributed to each pressure generation chamber 235 through each corresponding ink supply path 237. Practically, the piezoelectric actuator 211 is contracted when a voltage is applied to the piezoelectric actuator 211. Therefore, the diaphragm 232 is deformed along with the piezoelectric actuator 211, and thus a volume of the pressure generation chamber 235 is expanded. Accordingly, the ink is drawn into the pressure generation chamber 235. Then, an inner portion of the pressure generation chamber 235 is filled with the ink to the extent that the ink reaches the nozzle opening 238. Subsequently, the voltage applied to both electrodes 215 and 216 of the piezoelectric actuator 211 is released according to a recording signal supplied through the circuit substrate 221. Therefore, the piezoelectric actuator 211 is expanded and returns to an initial state. The diaphragm 232 is also displaced and returns to an initial state. As a result, the volume of the pressure generation chamber 235 is contracted and the pressure in the pressure generation chamber 235 increases. Thus the ink droplets are discharged through the nozzle openings 238.

Meanwhile, the flow-path member 30 is fixed to the case 250 of the head main body 20 in a state where the wiring substrate 40 is interposed between the flow-path member 30 and the case 250. Here, detail of the flow-path member 30 will be described with reference to FIGS. 3 to 7B.

Figure 3:
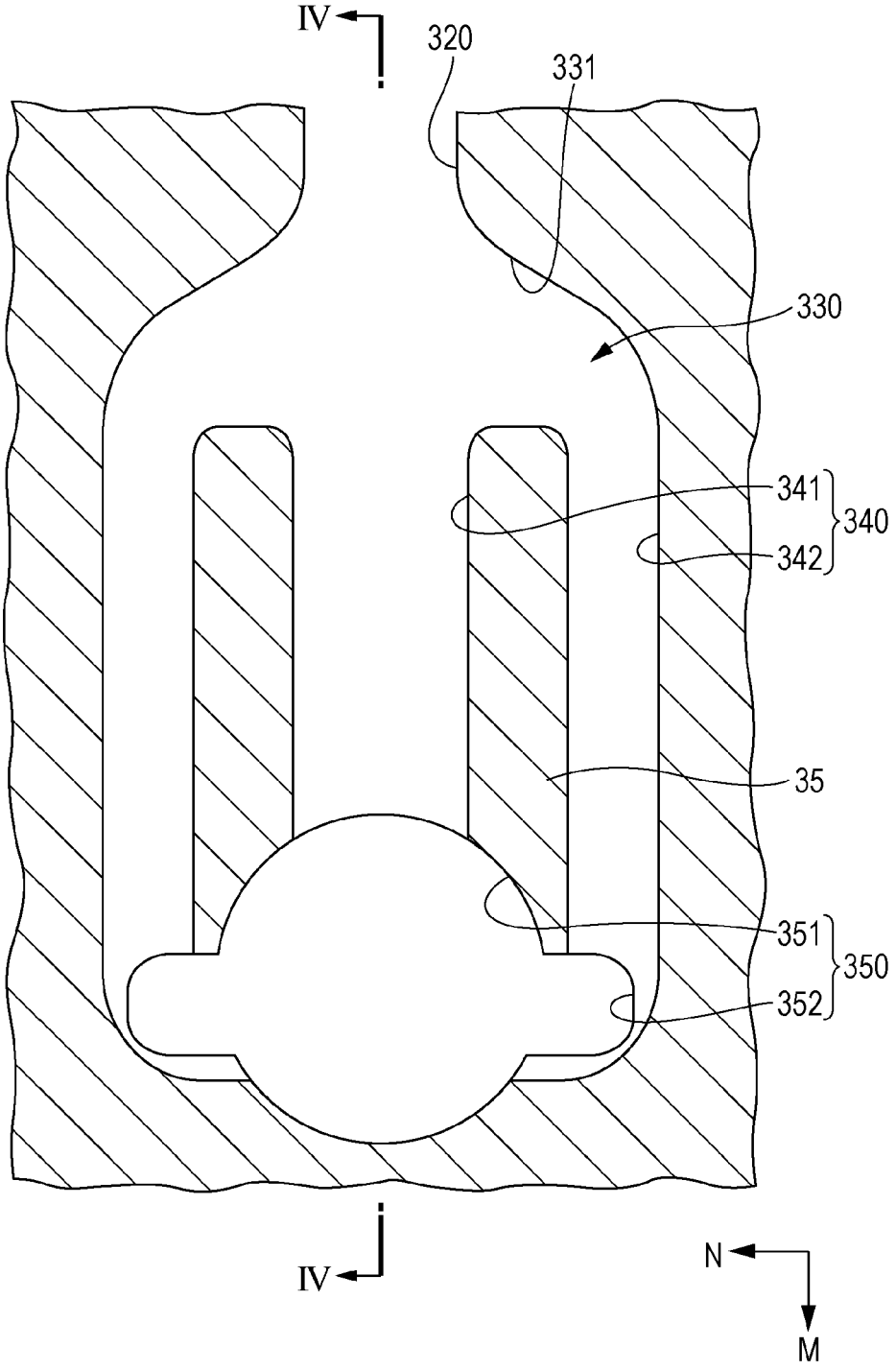
FIG. 3 is a plan view of an example of a flow-path member.
Figure 4:
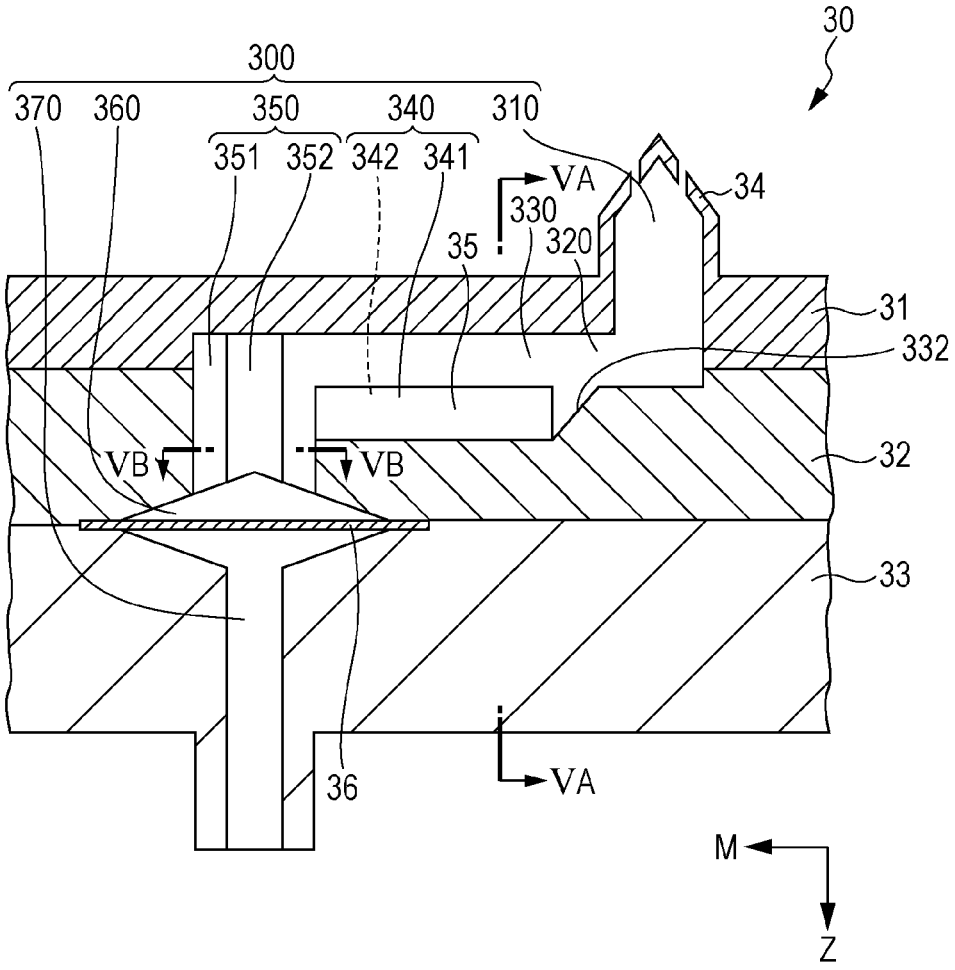
FIG. 4 is a cross-sectional view of an example of the flow-path member.
Figure 5A:
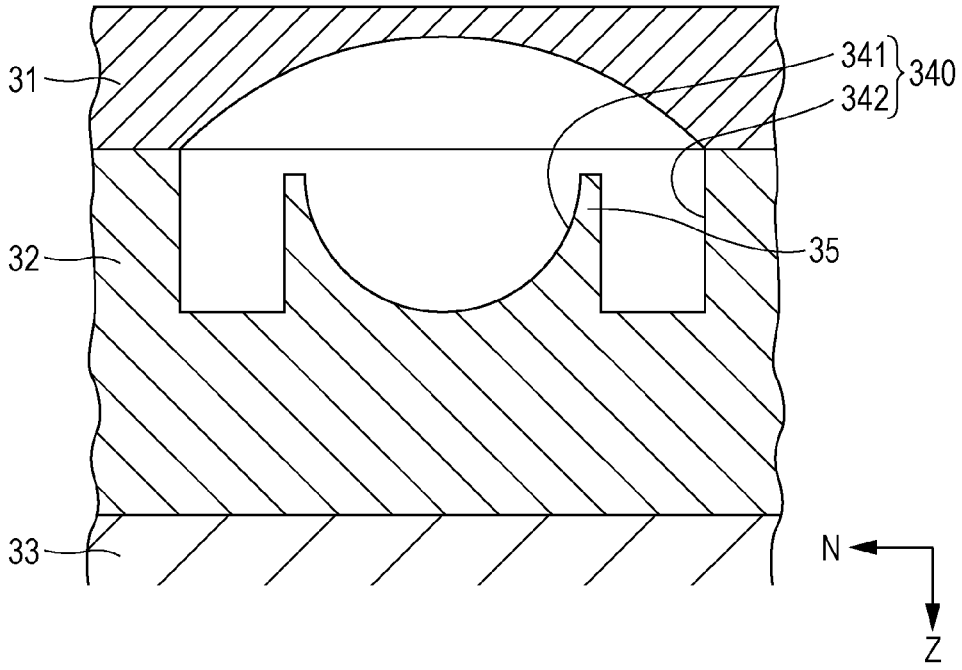
FIGS. 5A and 5B are cross-sectional views of example principal portions of the flow-path member.
Figure 5B:
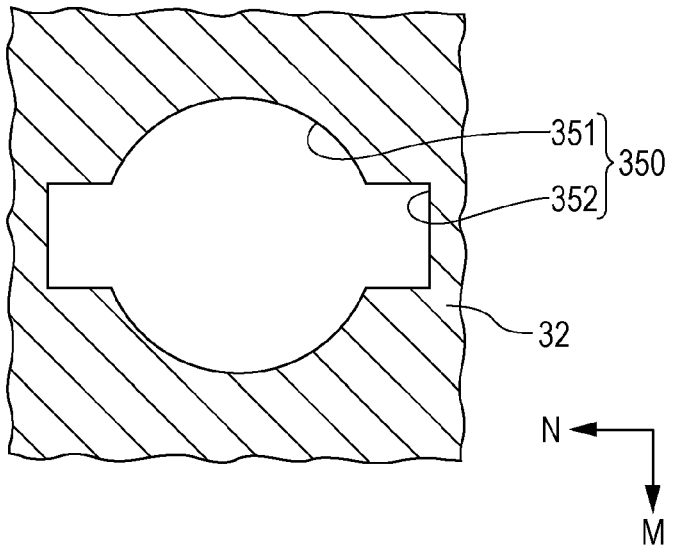
Figure 6A:
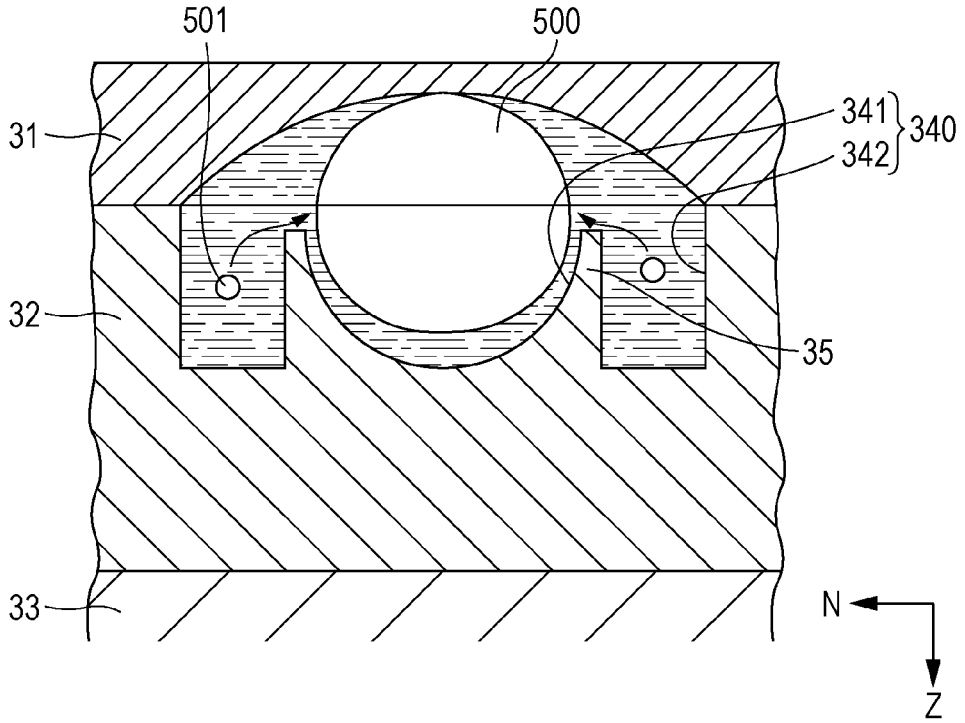
FIGS. 6A and 6B are cross-sectional views of example principal portions of the flow-path member.
Figure 6B:
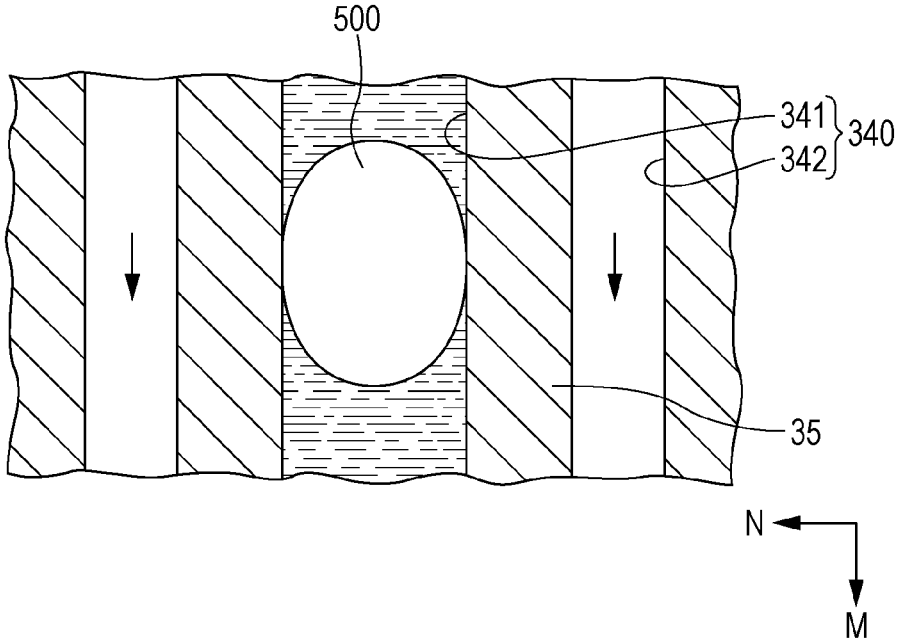
Figure 7A:
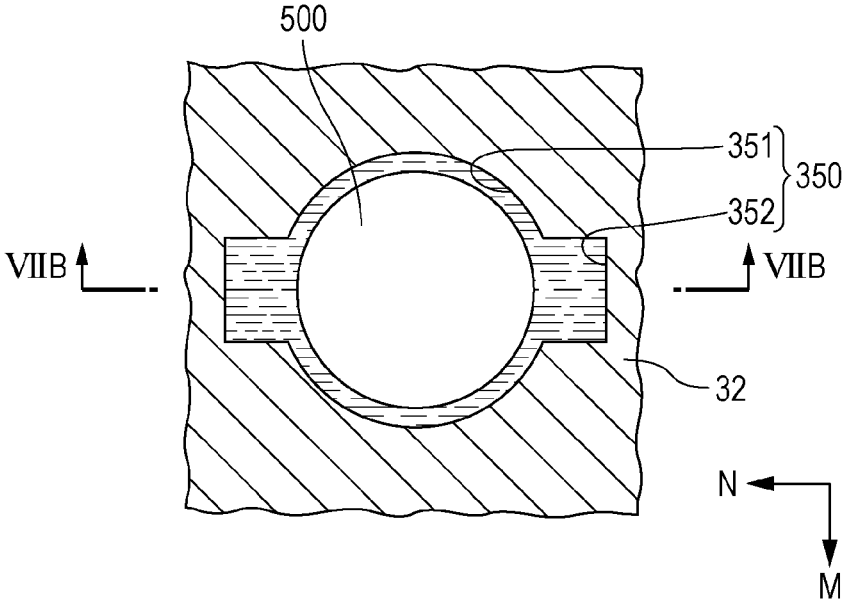
FIGS. 7A and 7B are cross-sectional views of example principal portions of the flow-path member.
Figure 7B:
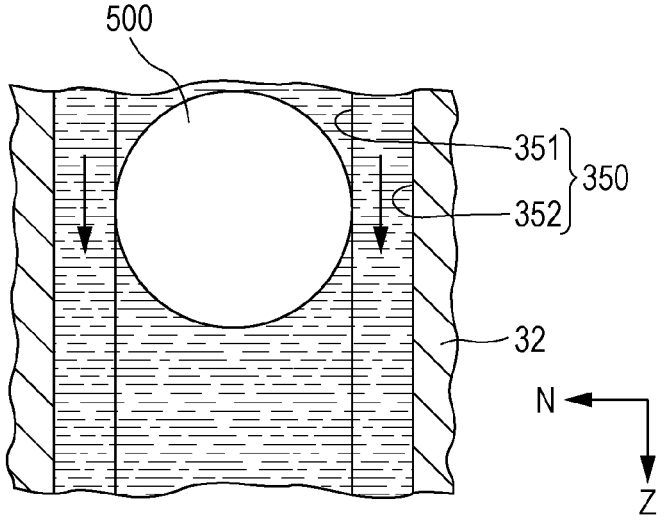

FIG. 3 is a plan view illustrating an example of a flow-path member. FIG. 4 is a cross-sectional view taken along the line IV-IV in FIG. 3. FIGS. 5A and 5B are cross-sectional views taken along the line VA-VA and the line VB-VB in FIG. 4. FIGS. 6A and 6B are a plan view and a cross-sectional view illustrating a state in which ink flows through an inner portion of the flow-path member. FIGS. 7A and 7B are cross-sectional views illustrating a state in which ink flows through the inner portion of the flow-path member, one of which is taken along the line VIIB-VIIB.

The flow-path member 30 is constituted by stacking a first flow-path member 31, a second flow-path member 32, and a third flow-path member 33, as illustrated in the accompanying drawings. A flow path 300 through which the ink flow is provided in the flow-path member 30.

Specifically, the flow-path member 30 may include the first flow-path member 31 to which the liquid receiving portion in which liquid is received is connected, the second flow-path member 32 which is provided on a surface side of the first flow-path member 31, which is a side opposite to a surface connected to the liquid receiving portion, and the third flow-path member 33 which is provided on a surface side of the second flow-path member 32, which is a side opposite to the first flow-path member 31 and holds the head main body 20. In the flow-path member 30, the first flow-path member 31, the second flow-path member 32, and the third flow-path member 33 are stacked in a vertical direction Z.

The flow path 300 provided in the flow-path member 30 includes an introduction flow path 310 which is connected to the liquid receiving portion in which liquid is received and supplied the ink, the first flow path 320 which is connected to a downstream side of the introduction flow path 310, a linking flow path 330 which is provided further on a downstream side than the first flow path 320 and is connected to the first flow path 320, a second flow path 340 which is connected to a downstream side of the linking flow path 330, a third flow path 350 which is connected to a downstream side of the second flow path 340, a filter chamber 360 which communicates with the third flow path 350 and in which a filter 36 is provided, and a fourth flow path 370 which communicates with the filter chamber 360 and supplies the ink to the head main body 20.

In the flow-path member 30 described above, the ink received in the liquid receiving portion is supplied through the introduction flow path 310 and passes through the first flow path 320, the linking flow path 330, the second flow path 340, the third flow path 350, the filter chamber 360, and the fourth flow path 370, in order, and then is supplied to the head main body 20.

In one example, the introduction flow path 310 is formed in a shape in which the ink (liquid) flows in the vertical direction Z. Flowing of ink (liquid) in the vertical direction Z means that an ink (liquid) flowing direction contains a component (a vector) directed to the vertical direction Z. Therefore, the introduction flow path 310 may not include a component extending in the horizontal direction perpendicular to the vertical direction Z and may also include a component extending in a direction inclined to the vertical direction Z. In one embodiment, the introduction flow path 310 is formed in a shape in which the ink flows in the vertical direction Z. However, the configuration is not limited thereto. The introduction flow path 310 may be formed in a shape in which the ink flows in the horizontal direction perpendicular to the vertical direction Z.

The introduction flow path 310 is provided in a connection portion 34. The connection portion 34 may have a needle shape and may be provided inside the first flow-path member 31. The connection portion 34 may be integrally formed with the first flow-path member 31. The introduction flow path 310 through which the ink flows in the vertical direction may be provided inside the first flow-path member 31.

The introduction flow path 310 may be formed in a tapered shape in which an opening size of the introduction flow path 310 is gradually reduced in a tip of the connection portion 34. The opening size of the introduction flow path 310 is substantially the same in the vertical direction, in a position lower than a tip portion of the connection portion 34. In other words, the introduction flow path 310 is formed in a shape in which a cross-sectional area in the horizontal direction is substantially the same in an ink flowing direction, except for a portion formed in the tip portion of the connection portion 34.

Although described below in detail, a central flow path for a second flow path 341 and a central flow path for a third flow path 351 for accommodating an air bubble are respectively provided in the second flow path 340 and the third flow path 350. Thus, it is not necessary to form a vertically long space functioning as an air bubble remaining portion in the connection portion 34. Furthermore, the central flow path for second flow path 341 is provided in the second flow path 340, which is extended horizontally. Thus it is possible to shorten a length of the first flow path 320 in the vertical direction Z. As a result, a length of the connection portion 34 in the vertical direction Z is reduced, and thus it is possible to reduce a height of the entirety of the flow-path member in the vertical direction. Incidentally, in a case where only the introduction flow path 310, the third flow path 350, the filter chamber 360, and the fourth flow path 370 through which the ink flows in the vertical direction Z are provided in the flow-path member 30, without providing, in the flow-path member 30, the second flow path 340 through which the ink flow in the horizontal direction, it is necessary to form a long flow path 300 so as to have a shape extended in the vertical direction Z because a volume for accommodating an air bubble is small. Therefore, the size of the flow-path member 30 increases in the vertical direction Z.

The first flow path 320 is provided to communicate with a downstream side of the introduction flow path 310. In one embodiment, first flow path 320 is formed in a shape in which the ink (liquid) flows in the horizontal direction perpendicular to the vertical direction Z. Hereinafter, a direction in which the ink flows through the first flow path 320 will be referred to as a third direction M. Flowing of the ink (the liquid) in the horizontal direction means that an ink (liquid) flowing direction (the third direction M) contains a component (a vector) directed to the horizontal direction. Therefore, the first flow path 320 may not include a component extending in the vertical direction Z and may also include a component extending in a direction inclined to the horizontal direction. In one example, the first flow path 320 is a horizontal flow path. However, the configuration is not limited thereto. The first flow path 320 may be formed in a shape in which the ink flows in the vertical direction Z. The third direction M in which the ink flows through the first flow path 320 may be the same direction as the first direction X or the second direction Y of the ink jet type recording head 10 described above or may be a direction different from the first direction X and the second direction Y, that is, a direction including both the first direction X and the second direction Y.

The linking flow path 330 allows the first flow path 320 to communicate with the second flow path 340 which is described below in detail. In one embodiment, a width of the second flow path 340 is wider than a width of the first flow path 320 and the depth of the second flow path 340 is deeper than a depth of the first flow path 320. Therefore, an inclined portion is provided, in a width direction, in the linking flow path 330, from the first flow path 320 to the second flow path 340. A linking flow path 330 having the inclined portion indicates that at least a part of the lateral surfaces on both sides of the linking flow path 330 in the width direction are an inclined surface. In one example, almost the entirety of the lateral surfaces on both sides of the linking flow path 330 in the width direction forms a first inclined surface 331. In other words, although the first flow path 320 and the second flow path 340 have a difference in width, the linking flow path 330 allows both paths to be continuously connected. The first inclined surface 331 is formed to extend in an inclination direction in which the width of the first flow path 320 gradually increases as the first flow path 320 comes close to the second flow path 340. Furthermore, the width of the linking flow path 330 referred to in this case indicates an opening width in a direction perpendicular to, in the horizontal direction, the ink flowing direction (the third direction M). Hereinafter, the width direction of flow paths, such as the first flow path 320, the linking flow path 330, and the second flow path 340, will be referred to as a fourth direction N.

Furthermore, an inclined portion is provided, in the depth direction, in the linking flow path 330, from the first flow path 320 to the second flow path 340. The linking flow path 330 having an inclined portion in the depth direction indicates that a part of either an upper surface of a bottom surface of the linking flow path 330 in the depth direction or a part of both surfaces forms an inclined surface. In one example, upper surfaces (surfaces on an upper side in the vertical direction Z) of the first flow path 320 and the second flow path 340 form a substantially single surface and bottom surfaces (surfaces on a lower side in the vertical direction Z) thereof are formed to have a different height. Thus, almost the entirety of the bottom surface of the linking flow path 330 forms a second inclined surface 332. In other words, although the first flow path 320 and the second flow path 340 have a difference in depth (in the vertical direction Z) or have different depths, the linking flow path 330 allows both paths to be continuously connected in the second inclined surface 332. The second inclined surface 332 is formed to extend in an inclination direction in which the depth of the first flow path 320 gradually increases as the first flow path 320 comes close to the second flow path 340.

Incidentally, the first inclined surface 331 and the second inclined surface 332 of the linking flow path 330 may have a surface shape of which a cross-sectional surface in the third direction M is linearly formed. Alternatively, cross-sectional surfaces of the first inclined surface 331 and the second inclined surface 332 may be a curved surface (a convex surface or a concave surface). The cross-sectional surface may have a polygonal shape constituted by a straight line, a curved line. In other words, the cross-sectional surfaces of the first inclined surface 331 and the second inclined surface 332 of the linking flow path 330 may have a linear shape, a curved shape, or a polygonal shape as long as the width (in the fourth direction N) of the linking flow path 330 and the depth (in the vertical direction Z) thereof gradually increase from the first flow path 320 to the second flow path 340. Furthermore, the linking flow path 330 may be formed in a shape of which the width gradually increases in a stepwise shape from the first flow path 320 to the second flow path 340.

The second flow path 340 is formed in a shape in which the ink flows in the horizontal direction perpendicular to the vertical direction Z. Flowing of the ink (the liquid) in the horizontal direction means that the ink (liquid) flowing direction contains a component (a vector) directed to the horizontal direction. Therefore, the second flow path 340 may not include a component extending in the vertical direction Z and may also include a component extending in a direction inclined to the horizontal direction. In one example, the second flow path 340 is disposed in a state where the ink flows in the third direction M, similarly to the first flow path 320. Needless to say, the second flow path 340 may be formed in a shape in which the ink flows in the horizontal direction or in a direction different from the first flow path 320.

The second flow path 340 may include a central flow path (341) and external flow paths (342). A central flow path 341 (or central flow path for second flow path 341) is a central flow path and is provided in the central side or in a center area of the second flow path 340. External flow paths 342 (or external flow paths for flow path 342) are external flow paths and are provided on both sides of the central flow path 341. The central flow path 341 and the external flow paths 342 are provided in the second flow path 340. In one example, the central flow path 341 and the external flow paths 342 are partitioned by or separated by wall portions 35.

The central flow path 341 may have a cylindrical shape of which an axial direction (a height direction) is set to be parallel to the horizontal direction. One end of the central flow path 341 communicates with the linking flow path 330 and the other end thereof communicates with the third flow path 350 described below in detail.

The external flow paths 342 are provided on both sides of the central flow path 341 in the horizontal direction in one example. In this case, both sides in the horizontal direction refer to sides in a direction perpendicular to, in the horizontal direction, the ink flowing direction. This direction is the fourth direction N in one example.

The external flow path 342 and the central flow path 341 are formed to have substantially the same length in the ink flowing direction (the third direction M). One end of the external flow path 342 communicates with the linking flow path 330 and the other end thereof communicates with the third flow path 350 described below in detail.

The external flow path 342 and the central flow path 341 are formed to have substantially the same depth (in the vertical direction Z) in one example.

The external flow path 342 and the central flow path 341 communicate with each other on an upper side in the vertical direction Z. In other words, the central flow path 341 and the external flow path 342 are partitioned by the wall portion 35 provided on a lower side of an area in the vertical direction, in which both paths communicate with each other. Thus, the wall portion 35 may not extend from a bottom of the second flow path 340 to a top of the second flow path 340 in a vertical direction.

The external flow path 342 has a width less than the width of the central flow path 341. In this case, the width of the flow path refers to a width in a direction perpendicular to, in the horizontal direction, the ink flowing direction, which direction is the fourth direction N in one example.

In an initial state, in the second flow path 340 described above, the ink flows in an inner portion of the central flow path 341 and the external flow path 342. Then, when an air bubble 500 in the ink grows, the air bubble 500 is held in the central flow path 341, as illustrated in FIGS. 6A and 6B. In this case, even when the air bubble 500 remains in the central flow path 341, the ink can pass through the external flow path 342. Thus, the second flow path 340 is prevented from being choked by the air bubble 500. In other words, the central flow path 341 and the external flow path 342 are provided as the second flow path 340. This configuration allows the relatively large air bubble 500 to be accommodated in the central flow path 341 while still allowing ink to flow in the second flow path 340.

Incidentally, in a case where, the external flow path 342 is not provided and only the central flow path 341 is provided, it is not possible to accommodate the large air bubble 500 in the second flow path 340 such that the second flow path 340 is prevented from being choked by the grown air bubble 500. In other words, the second flow path 340 is blocked or chocked by the air bubble 500 when only the central flow path 341 is provided. Thus, it is necessary to increase the frequency of a cleaning operation in which the ink or the air bubble 500 in the second flow path 340 is forcibly discharged through the nozzle openings 238. This results in an increase in wasteful consumption of the ink. In one example, the central flow path 341 and the external flow path 342 are provided as the second flow path 340. Thus, even when the relatively large air bubble 500 is accommodated in the central flow path 341, the ink can be supplied through the external flow path 342. Therefore, it is not necessary to perform the cleaning operation until the air bubble 500 grows relatively large. As a result, it is possible to reduce the wasteful consumption of the ink by reducing the frequency of the cleaning operation.

The central flow path 341 and the external flow path 342 are partitioned by the wall portion 35 provided on the lower side of the area in the vertical direction. This configuration allows both paths to communicate with each other. Thus, an air bubble 501 which is contained in the ink passing through the external flow path 342 is effectively discharged to the central flow path for second flow path 341. Thus it is difficult for the air bubble 501 in the ink to flow to the third flow path 350 side on the downstream side. Furthermore, the air bubble 500 accommodated in the central flow path 341 can be prevented from entering an inner portion of the external flow 342.

Furthermore, the external flow path 342 and the central flow path 341 are configured so that both paths communicate with each other and continuously extend throughout the second flow path 340 in the ink flowing direction. Thus the air bubble which is contained in the ink passing through the external flow path 342 is reliably discharged to the central flow path 341.

In one example, the external flow paths 342 are provided on both sides of the central flow path 341 in the width direction (which is a direction perpendicular to, in the horizontal direction, the ink flowing direction and is the third direction M). Thus, upon comparison with a case in which the external flow path 342 having a concave shape is provided on a bottom surface (on a lower side in the vertical direction Z) of the central flow path 341, it is possible to reduce the thickness of a member (the second flow-path member 32). Therefore, it is possible to reduce the height of the flow-path member 30 and the height of the ink jet type recording head 10.

In one example, the external flow path 342 is formed to have substantially the same depth (the depth in the vertical direction Z) as that of the central flow path 341. Thus, it is possible to ensure an opening area in the entirety of the external flow path 342, by providing only two external flow paths 342, without thickening the second flow-path member 32. As a result, a flow-path resistance of the entirety of the external flow path 342 is prevented from increasing, and thus it is possible to ensure a desired flow rate. One or more external flow paths 342 may be provided.

In one example, the external flow paths 342 are provided on both sides of the central flow path 341 in the width direction (which is a direction perpendicular to, in the horizontal direction, the ink flowing direction and is the third direction M). Thus, upon comparison with a case in which an external flow path having a concave shape is provided on a bottom surface (on a lower side in the vertical direction Z) of the central flow path 341, it is possible to improve air-bubble discharge properties. In other words, when an external flow path having an concave shape is provided on the bottom surface (on the lower side in the vertical direction Z) of the central flow path 341, during the initial filling period in which the flow path not filled with the ink is filled with the ink for the first time, the ink of which the amount is small when the ink starts to flow flows in only the external flow path having a concave shape. Thus, the air bubbles in the ink are likely to remain in the external flow path having a concave shape. In one example, an external flow path having a concave shape is not provided on the bottom surface (on the lower side in the vertical direction Z) of the central flow path 341. Thus an air bubbles in an ink of which an amount is small in the initial filling period is also likely to flow to a downstream side.

In one example, the linking flow path 330 which links the first flow path 320 to the second flow path 340 is provided. The wall portion 35 of the second flow path 340 is not provided in the linking flow path 330. Thus, when the ink flows from the first flow path 320 to the second flow path 340 or, more specifically, to the external flow path 342, the flow-path resistance of the ink is prevented from increasing. As a result, ink supply failure is prevented from occurring.

Particularly, during an initial filling period in which the flow path not filled with the ink is filled with the ink for the first time, it is possible to prevent an ink supply failure from the first flow path 320 to the second flow path 340. When the wall portion 35 is provided in the linking flow path 330, an opening area of the external flow path 342, which is located on the first flow path 320 side, is reduced. Therefore, a flow-path resistance is applied to the ink flowing from the first flow path 320 to the external flow path for second flow path 342, and thus there is a possibility that an ink flow rate may be limited or reduced.

Lateral surfaces of the linking flow path 330 in the width direction and the bottom surface of the linking flow path 330 is constituted by the first inclined surface 331 and the second inclined surface 332, as described above. Thus, when the ink flows from the first flow path 320 to the second flow path 340 through the linking flow path 330, air bubbles are prevented from remaining in the linking flow path 330. As a result, it is possible to prevent an ink filling failure.

In a case where the first inclined surface 331 and the second inclined surface 332 are not provided in the linking flow path 330, the opening width and the opening depth rapidly increase from the first flow path 320 to the second flow path 340, and thus there is a possibility for problems to occur. For example, the air bubble remains in a corner portion of the linking flow path 330. Then, the remaining air bubble grows and flows to the head main body 20 side at an unexpected time. As a result, a failure such as ink-droplet discharging failure may be caused due to the air bubbles flowing into the head main body 20 side. In addition, when the air bubble remains in, for example, the corner portion of the linking flow path 330, there is a possibility that the external flow path 342 may be choked by the air bubble. In one example, the first inclined surface 331 and the second inclined surface 332 are provided in lateral surfaces of the linking flow path 330 in the width direction and a bottom surface of the linking flow path 330, and thus an area in which the air bubble is likely to remain is reduced. As a result, it is possible to prevent failure or problems that may be caused by an air bubble that remains. An air bubble is likely to remain during, particularly, the initial filling period. However, the first inclined surface 331 and the second inclined surface 332 are provided in the linking flow path 330. Thus it is possible to prevent a filling failure by preventing an air bubble from remaining during the initial filling period.

The third flow path 350 is formed in a shape in which the ink flows in the vertical direction Z. Flowing of ink (liquid) in the vertical direction Z indicates that an ink (liquid) flowing direction contains a component (a vector) directed to the vertical direction Z. Therefore, the third flow path 350 may not include a component extending in the horizontal direction perpendicular to the vertical direction Z and may also include a component extending in a direction inclined to vertical direction Z.

The central flow path 351 (or central flow path for third flow path 351) is a central flow path for the third flow path 350 and is provided in the central side (or center region). External flow paths 352 (or external flow paths for third flow path 352) are external flow paths for the third flow path 350 and are provided on both sides of the central flow path 351. Thus, the third flow path 350 is provided with the central flow path 351 and the external flow paths 352 in one example.

The central flow path 351 may have a cylindrical shape of which an axial direction (a height direction) is set to be parallel to the vertical direction Z. One end of the central flow path 351 communicates with the second flow path 340 and the other end thereof communicates with the filter chamber 360.

The external flow paths 352 are provided on both sides of the central flow path 351 in the width direction. In this case, both sides of the central flow path 351 in the horizontal direction refer to sides in a direction perpendicular to the ink flowing direction of the central flow path for third flow path 351. In one example, the width direction of the central flow path 351 is parallel to the fourth direction N. Incidentally, the external flow paths 352 may be provided on both sides of the third flow path 350 in an alignment direction. When the external flow paths 352 are provided on both sides of the third flow path 350 in the alignment direction, it is not necessary to provide, in a direction perpendicular to the alignment direction, a space for forming a flow path. Therefore, an area of the second flow-path member 32 is reduced, and thus it is possible to reduce the size of the second flow-path member 32. That is, it is possible to achieve a reduction of the flow-path member 30 in size.

The external flow path 352 extends in the vertical direction Z in a state where a cross-sectional surface thereof in a direction perpendicular to the ink flowing direction has a concave shape. In addition, the external flow path 352 is formed to have substantially the same length, in the ink flowing direction, as the central flow path 351. In other words, the external flow path 352 is provided in a wall surface of the central flow path 351 so as to be continuously opened in the vertical direction Z.

In an initial state, in the third flow path 350 described above, the ink flows in an inner portion of the central flow path 351 and the external flow path 352. Then, when the air bubble 500 in the ink grows, the air bubble 500 is held in the central flow path 351, as illustrated in FIGS. 7A and 7B. In this case, even when the air bubble 500 remains in the central flow path 351, the ink can pass through the external flow path 352. Thus, the third flow path 350 is prevented from being choked by the air bubble 500. In other words, when the central flow path 351 and the external flow path 352 are provided as or included in the third flow path 350, the relatively large air bubble 500 can be accommodated in the central flow path 351.

In a case where the external flow path 352 is not provided and only the central flow path 351 is provided as the third flow path 350, it is not possible to accommodate the large air bubble 500 in the third flow path 350 such that the third flow path 350 is prevented from being choked by the grown air bubble 500. Thus, it is necessary to increase the frequency of a cleaning operation in which the ink or the air bubble 500 in the third flow path 350 is forcibly discharged through the nozzle openings 238. This results in an increase in wasteful consumption of the ink. In one example, the central flow path 351 and the external flow path 352 are provided as the third flow path 350. Thus, even when the relatively large air bubble 500 is accommodated in the central flow path 351, the ink can be supplied through the external flow path 352. As a result, it is possible to reduce wasteful consumption of the ink by reducing the frequency of the cleaning operation.

Furthermore, the central flow path 351 and the external flow path 352 are configured so that both paths communicate with each other and continuously extend throughout the third flow path 350 in the vertical direction Z. Thus, in a case where the air bubble 500 is accommodated in the central flow path 351, even when the central flow path 351 is closed by the air bubble 500, it is possible to reliably supply the ink to the downstream side through the external flow path 352.

In one example, the external flow paths 352 are provided on both sides of the central flow path 351 in the width direction (the fourth direction N). In addition, the third flow path 350 is provided to extend in the fourth direction N. Therefore, a space for providing the external flow path for third flow path 352 is reduced, and thus it is possible to realize a reduction in size. In other words, in a case where the external flow path 352 is provided to extend in a direction perpendicular to the alignment direction of the third flow path 350, the flow-path member 30 increases in size, because it is necessary to provide a space for providing the external flow path for third flow path 352. However, in one embodiment of the invention, the external flow path 352 is provided only in a predetermined direction. Thus it is possible to realize a space savings. As a result, it is possible to reduce the size of the flow-path member 30.

In addition, the filter chamber 360 and the fourth flow path 370 may also be provided in the flow-path member 30. The filter chamber 360 communicates with the third flow path 350 on a side opposite to the second flow path 340. The fourth flow path 370 communicates with the filter chamber 360 and communicates with the ink introduction path 251 of the head main body 20.

The filter chamber 360 is formed in a portion between the second flow-path member 32 and the third flow-path member 33, in a shape in which an opening area (in a cross-sectional direction perpendicular to the ink flowing direction) of the filter chamber 360 is set to be wider than the fourth flow path 370 or the third flow path 350.

In one example, the filter chamber 360 is formed in a shape in which the opening area thereof gradually increases from a portion in which the filter chamber 360 communicates with the third flow path 350 to a boundary between the second flow-path member 32 and the third flow-path member 33, and the opening area thereof is gradually reduced from a boundary between the third flow-path member 33 and the second flow-path member 32 to a side in which the filter chamber 360 communicates with the fourth flow path 370.

In the filter chamber 360, a filter 36 which removes, for example, foreign matter or air bubbles in the ink is provided in a portion between the second flow-path member 32 and the third flow-path member 33. The filter chamber 360 is formed in shape in which the opening area thereof is a maximum in or at a boundary portion between the second flow-path member 32 and the third flow-path member 33, as described above. Since the filter 36 is provided in a boundary portion between the second flow-path member 32 and the third flow-path member 33, an effective area of the filter 36 can be increased.

Furthermore, in one example, the fourth flow path 370 communicating with the filter chamber 360 is formed in a shape in which an opening area of the fourth flow path 370 is set to be substantially constant in the vertical direction Z.

In the flow-path member 30, the connection portion 34 is inserted into the ink cartridge in such a manner that an ink cartridge in which the ink is received is mounted on a surface of the first flow-path member 31. The surface of the first flow-path member 31 may be a surface having the connection portion 34. Therefore, the ink in the ink cartridge is supplied from the introduction flow path 310 to the head main body 20, through the first flow path 320, the linking flow path 330, the second flow path 340, the third flow path 350, the filter chamber 360, and the fourth flow path 370.

Needless to say, the connection portion 34 may not be directly connected to the ink cartridge and may be connected to a supply tube connected to an ink receiving portion, such as an ink tank.

Hereinbefore, embodiments of the invention are described. However, a basic configuration of the invention is not limited to the configuration described above.

A configuration in which the depth of the second flow path 340 in the vertical direction Z is greater than that of the first flow path 320 is exemplified in embodiments described above. However, the configuration is not limited thereto. The depth of the second flow path 340 in the vertical direction Z may be the same as that of the first flow path 320. Alternatively, the depth of the second flow path 340 in the vertical direction Z may be less than that of the first flow path 320. The depth direction is not limited to the direction described above, as long as the width of the second flow path 340 is greater than that of the first flow path 320 in one embodiment.

A configuration in which the third flow path 350 includes the central flow path 351 and the external flow path 352 is described previously. However, the configuration is not limited thereto. The third flow path 350 may be constituted by only the central flow path 351. In this case, a capacity of the third flow path 350 for accommodating an air bubble is reduced. However, the second flow path 340 can accommodate a large air bubble. Therefore, upon comparison with a case of the related art, in which the air bubbles are accommodated in the connection portion 34, the flow-path member 30 of a less height in the vertical direction Z can accommodate a greater amount of air bubbles.

In addition, the introduction flow path 310, the first flow path 320, the linking flow path 330, the second flow path 340, the third flow path 350, the filter chamber 360, and the fourth flow path 370 are provided in the flow-path member 30 as described above. However, the configuration is not limited thereto. As long as the first flow path 320, the linking flow path 330, and the second flow path 340 are provided in a portion between the liquid receiving portion and the filter 36, the flow-path member 30 may have any configuration in which some flow paths except for the paths described above are not provided or an additional flow path is provided.

In the description above, a longitudinal vibration type piezoelectric actuator 211 in which piezoelectric materials 214 and electrodes 215 and 216 are alternately stacked on each other and the stacked members expand and contract in an axial direction is used as a pressure generation unit which generates a pressure change in the pressure generation chamber 235. However, the pressure generation unit is not particularly limited thereto. A bending vibration type piezoelectric actuator, such as a thin-film type actuator in which electrodes and piezoelectric materials are stacked on each other by film forming and a lithography method and a piezoelectric film type actuator which is formed by, for example, attaching a green sheet can be used as a pressure generation unit. Furthermore, an actuator in which a heater element is disposed in the pressure generation chamber and liquid droplets are discharged through nozzle openings by bubbles generated by heating of the heater element can be used as a pressure generation unit. An actuator or a so-called electrostatic actuator in which static electricity is generated between the diaphragm and an electrode and liquid droplets are discharged through nozzle openings by deforming the diaphragm using an electrostatic force can be used as a pressure generation unit.

Figure 8:
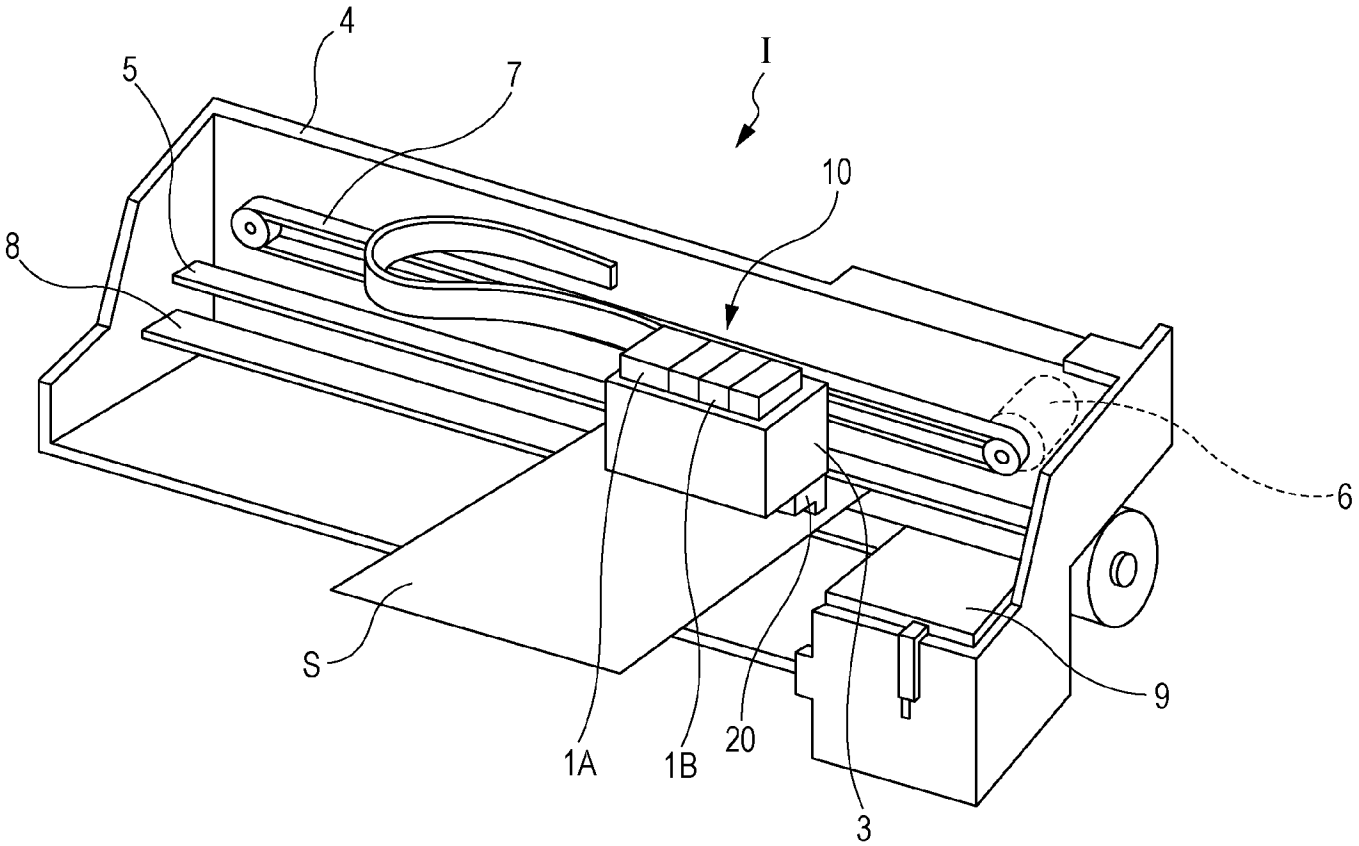
FIG. 8 is a schematic view of an example of a recording apparatus.

The ink jet type recording head 10 of each embodiment described above constitutes a part of an ink jet type recording head unit which has an ink flow path communicating with an ink cartridge or the like. The ink jet type recording head 10 is mounted on an ink jet type recording apparatus. FIG. 8 is a schematic view of an example of the ink jet type recording apparatus.

In an ink jet type recording apparatus I illustrated in FIG. 8, cartridges 1A and 1B which constitute an ink supply unit are attachably/detachably installed on an ink jet type recording head unit 1 (hereinafter, referred to as a head unit 1) having a plurality of the ink jet type recording heads 10, and a carriage 3 on which the head unit 1 is mounted is installed on a carriage shaft 5 attached to an apparatus main body 4 so as to be movable in a shaft direction are illustrated. This recording head unit 1 discharges, for example, a black ink composition and a color ink composition.

The carriage 3 on which the head unit 1 is mounted moves along the carriage shaft 5, in such a manner that a driving force from a driving motor 6 is transmitted to the carriage 3 through a plurality of gears (not illustrated) and a timing belt 7. A platen 8 is provided in the apparatus main body 4 in a state where the platen 8 extends along the carriage shaft 5. In addition, a recording sheet S, which is a recording medium such as a paper sheet, is fed by, for example, a paper feeding roller (not illustrated), is wound around the platen 8 and transported.

In the above description of the ink jet type recording apparatus I, a recording apparatus in which the ink jet type recording head 10 (the head unit 1) is mounted on the carriage 3 and moves in a main scanning direction is exemplified. However, the recording apparatus is not limited thereto. Embodiments of the invention can be applied to a so-called line type recording apparatus in which the ink jet type recording head 10 is fixed and printing is performed by simply moving the recording sheet S, such as a paper sheet, in a sub-scanning direction.

Although the ink jet type recording head 10 having the flow-path member 30 is exemplified in the example described above, embodiments of the invention can also be applied to an ink jet type recording apparatus in which the flow-path member 30 is provided in a portion other than the ink jet type recording head 10. Specifically, in a case of an ink jet type recording apparatus in which a storage unit in which ink is stored is not mounted on the carriage 3 but is fixed to the apparatus main body 4 and the storage unit and the head main body 20 are connected by a supply tube, the flow-path member 30 may be provided in a position in which the storage unit is installed.

In the embodiments described above, an ink jet type recording head is exemplified as a liquid ejecting head and an ink jet type recording apparatus is exemplified as a liquid ejecting apparatus. However, embodiments of the invention is intended to be widely applied to general liquid ejecting heads and liquid ejecting apparatuses. Embodiments of the invention can also be applied to a liquid ejecting head which ejects liquid other than ink or a liquid ejecting apparatus. Examples of other liquid ejecting heads include various types of an recording head used for an image recording apparatus, such as a printer, a coloring material ejecting head used to manufacture a color filter for a liquid crystal display or the like, an electrode material ejecting head used to form an electrode for an organic EL display, a field emission display (FED) or the like, and a bio-organic material ejecting head used to manufacture a biochip. Embodiments of the invention can also be applied to a liquid ejecting apparatus having the liquid ejecting head described above.

What is claimed is:

1. A liquid ejecting head comprising:

a first flow path;

a linking flow path that is provided on a downstream side of the first flow path in a liquid flowing direction and that is connected to the first flow path; and a second flow path that is connected to the linking flow path and that extends in a horizontal direction perpendicular to a vertical direction, wherein the first flow path, the linking flow path and the second flow path are all provided in a portion between a liquid receiving portion in which liquid is received and a filter, wherein the second flow path includes:

wall portions that partition a central flow path of which a width in the horizontal direction is greater than a width of the first flow path and which is provided on a central side and that extends in the liquid flowing direction; and external flow paths which are provided on both external sides of the central flow path and are formed to have a width less than the width of the central flow path, and wherein the linking flow path has an inclined portion which is formed in a width direction and extends in a portion between the first flow path and the second flow path.

2. The liquid ejecting head according to claim 1, wherein a depth of the second flow path is greater than a depth of the first flow path and the linking flow path has an inclined portion which is formed in a depth direction and extends in a portion between the first flow path and the second flow path.

3. A liquid ejecting apparatus comprising:

the liquid ejecting head according to claim 2.

4. The liquid ejecting head according to claim 1, wherein the first flow path extends in the horizontal direction.

5. A liquid ejecting apparatus comprising:

the liquid ejecting head according to claim 4.

6. The liquid ejecting head according to claim 1, further comprising:

a third flow path which is connected to a downstream side of the second flow path and through which liquid flows in a vertical direction, wherein the third flow path includes a second central flow path provided on a central side and second external flow paths which are provided on both external sides of the second central flow path.

7. A liquid ejecting apparatus comprising:

the liquid ejecting head according to claim 6.

8. A liquid ejecting apparatus comprising:

the liquid ejecting head according to claim 1.

* * * * *